US007701185B2

(12) United States Patent
Matsuda

(10) Patent No.: US 7,701,185 B2
(45) Date of Patent: Apr. 20, 2010

(54) DIRECT CURRENT STABILIZATION POWER SUPPLY

(75) Inventor: Hideo Matsuda, Yamatotakada (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 86 days.

(21) Appl. No.: 12/230,583

(22) Filed: Sep. 2, 2008

(65) Prior Publication Data

US 2009/0058382 A1 Mar. 5, 2009

(30) Foreign Application Priority Data

Sep. 3, 2007 (JP) ..... 2007-227571

(51) Int. Cl.
*G05F 1/00* (2006.01)
*G05F 1/573* (2006.01)

(52) U.S. Cl. ..... 323/277; 323/274

(58) Field of Classification Search ..... 323/276, 323/277, 280, 274; 361/93.9, 18; 327/109, 327/321, 543

See application file for complete search history.

(56) References Cited

U.S. PATENT DOCUMENTS 4,536,699 A * 8/1985 Baker ..... 323/276
6,452,766 B1 * 9/2002 Carper ..... 361/18
2003/0128489 A1 7/2003 Katoh et al.

FOREIGN PATENT DOCUMENTS

JP 11-338560 A 12/1999
JP 2002-169618 A 6/2002
JP 2004-348216 A 12/2004
JP 2005-251130 A 9/2005

* cited by examiner

*Primary Examiner*—Shawn Riley
(74) *Attorney, Agent, or Firm*—Birch, Stewart, Kolasch & Birch, LLP

(57) ABSTRACT

A direct current stabilization power supply apparatus, comprising: an output control device which generates a voltage corresponding to a drive current given and outputs it as an output voltage; a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, wherein, when the comparison voltage is equal to or lower than a predetermined threshold voltage, the drive current limitation portion carries out an operation to hold the drive current at a predetermined lower-limit current value, or an operation to clamp a lower-limit value of the comparison voltage at a predetermined voltage value. Accordingly, even if the output voltage becomes a negative voltage, it is possible to secure a suitable drive current.

14 Claims, 9 Drawing Sheets

DIRECT CURRENT STABILIZATION POWER SUPPLY

CROSS-REFERENCE TO RELATED APPLICATIONS

This application is based on Japanese Patent Application No. 2007-227571 filed on Sep. 3, 2007, the contents of which are hereby incorporated by reference.

BACKGROUND OF THE INVENTION

1. Field of the Invention

The present invention relates to a direct current stabilization power supply apparatus which has an output short-circuit protection function.

2. Description of the Related Art

Conventionally, there are many direct current stabilization power supply apparatuses disclosed which have a protection function to protect an output transistor from a large current or a high power besides a regulator function to drive and control the output transistor to generate and output a desired output voltage. Among such direct current stabilization power supply apparatuses, there are many power supply apparatuses in which a correlation between an output voltage Vo and a drive current Ido shows a fold-back type drooping characteristic. In such a direct current stabilization power supply apparatus, when the output voltage drops, the drive current is limited according to the fold-back type drooping characteristic.

Here, a graph illustrating a general fold-back type drooping characteristic is shown in FIG. 12. As the graph shows, when the output voltage drops, the drive current is limited according to the fold-back type drooping characteristic. Conventionally, there is a problem that when the power supply apparatus is turned on with the output voltage being a negative voltage, the drive current becomes 0 and the output voltage cannot be boosted. However, JP-A-2004-348216 proposes an improvement measure to this problem.

According to this improvement proposition, a correlation between the output voltage and the drive current has a fold-back type drooping characteristic shown in FIG. 13, and a drive current flows at the time of turning on the power supply apparatus even if the output voltage is a negative voltage. Accordingly, the output voltage starts up according to the fold-back type drooping characteristic shown in FIG. 13, and the problem mentioned above is eliminated. As another document on the prior art, besides the patent document mentioned above, there is JP-A-2005-251130.

In the power supply apparatus mentioned above, when lowering the drive current to curb heat quantity at the time of shot-circuit (Vo=0 V), it is necessary to drop, for example, a voltage that is clamped at the time of short-circuit to a negative voltage. However, by dropping the clamped voltage, the fold-back type drooping characteristic in the power supply apparatus becomes substantially the same as the antecedent fold-back type drooping characteristic, and the dive current can become 0 at a small negative voltage.

Besides, if the drive current at the time of short-circuit is excessively lowered, the drive current can become 0 even at a relatively low negative voltage (e.g, −0.1 V) because of temperature changes and differences in circuit-device characteristics. Accordingly, because it becomes hard to secure a stable operation at the time of turning on the power supply apparatus, it is not desirable to excessively lower the drive current at the time of shirt-circuit.

SUMMARY OF THE INVENTION

The present invention has been made to cope with the conventional problems, and it is an object of the present invention to provide a direct current stabilization power supply apparatus which makes it possible to secure a suitable drive current even if an output voltage becomes a negative voltage.

To achieve the above object, a direct current stabilization power supply apparatus according to the present invention comprises: an output control device which generates a voltage corresponding to a drive current given thereto and outputs it as an output voltage; a direct current stabilization portion which gives the drive current to the output control device to equalize a comparison voltage corresponding to the output voltage with a predetermined reference voltage and to make the output control device generate a desired output voltage; and a drive current limitation portion which monitors the comparison voltage and lowers the drive current according to a drop in the comparison voltage, wherein the drive current limitation portion includes current clamp means which holds the drive current at a predetermined lower-limit current value when the comparison voltage is equal to or lower than a predetermined threshold voltage.

According to this structure, because it is easy to lower the drive current (the fold-back type drooping characteristic is achieved) as the output voltage drops because of short-circuit on the output side or the like, it is possible to prevent an overcurrent from being erroneously output. On the other hand, if the comparison voltage becomes equal to or lower than the predetermined threshold voltage (e.g., a voltage at the time when the drive current reaches a lower-limit current value according to the fold-back type drooping characteristic), the drive current is held at the lower-limit current value. Accordingly, it becomes easy to make this lower-limit current value be a suitable value (the smallest possible value in a range where a stable operation can be secured at the time of turning on the power supply).

More specifically, in the structure described above, a detection portion which detects whether or not the comparison voltage is higher than the threshold voltage is provided, and the drive current limitation portion may be so structured as to hold the drive current at the lower-limit current value based on a detection result from the detection portion.

In the structure described above, a drive current detection portion for detecting how large the drive current is, and an overcurrent prevention portion for preventing the drive current from becoming an overcurrent based on a detection result from the drive current detection portion may be provided.

According to this structure, it becomes easy to prevent the drive current from becoming an overcurrent and to stably supply power.

Besides, in the structure described above, the drive current detection portion may be so structured that it has a current mirror circuit and uses the current mirror circuit to obtain a current (a drive monitor current) which correlates with the drive current.

According to this structure, because the current mirror circuit can generate a drive monitor current which correlates with the drive current, this drive monitor current can be used to accurately detect (monitor) the drive current (especially regardless of temperature changes and differences in device characteristics).

In the structure described above, change means which changes the lower-limit current value to any value may be provided.

According to this structure, because the lower-limit current value can be changed depending on a situation, it is possible to achieve a more general-purpose power supply apparatus.

A direct current stabilization power supply apparatus according to the present invention comprises: an output control device which generates a voltage corresponding to a drive current given thereto and outputs it as an output voltage; a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, the apparatus may further comprise: voltage clamp means for clamping a lower-limit value of the comparison voltage at a predetermined lower-limit voltage value; and means for correcting a fluctuation in a voltage clamped by the clamp means.

According to this structure, in the power supply apparatus in which the drive current decreases as the comparison voltage drops to achieve, for example, a fold-back type drooping characteristic, because it is possible to prevent the comparison voltage from becoming lower than the lower-limit current value, the drive current can be prevented from becoming 0. Because the lower-limit voltage value is suitably set, the lower-limit value of the drive current can be easily set to a desired value. Besides, because the means to correct a fluctuation in the clamped voltage is provided, a more accurate power supply apparatus is be achieved.

More specifically, in the structure described above, the voltage clamp means may be so structured that it has voltage generation means which generates a predetermined clamp reference voltage and uses the clamp reference voltage to carry out the clamp operation. Further specifically, in the structure described above, a shift circuit for shifting a value of the comparison voltage may be provided.

In the structure described above, the voltage generation means uses a first transistor to generate the clamp reference voltage, and the voltage clamp means includes a second transistor which carries out the clamp operation using the clamp reference voltage input, wherein the first and second transistors may be set to characteristics identical to each other.

According to the structure described above, in an embodiment, for example, a transistor TR82 is used as the first transistor to allow an easy generation of the clamp reference voltage, and a transistor TR85 is used as the second transistor to allow an easy achievement of the clamp operation. Besides, because these transistors are set to characteristics identical to each other, it is easy to cancel differences in the device performance and shifts in the temperature characteristics by each other, and a more accurate power supply apparatus can be achieved.

In the structure described above, the clamp reference voltage may be changed to another value.

According to this structure, a more general-purpose power supply can be achieved by suitably changing the value of the clamp reference voltage.

In addition, in the structure described above, a variable resistor portion to one end of the drive monitor current is input and the other end of which is grounded may be employed, and the overcurrent prevention portion may be so structured that it uses a voltage generated at the one end of the variable resistor portion to prevent the drive current from becoming an overcurrent.

According to this structure, the detection level (the level to determine an overcurrent) of the drive current can be adjusted by changing the resistance value of the variable resistor portion. Accordingly, it is possible to achieve a more general-purpose power supply apparatus.

More specifically, in the structure described above, the variable resistor portion may be so structured that it includes a plurality of resistance elements disposed in parallel with each other across the one end and the other end thereof, and each of the resistance elements can be trimmed.

A direct current stabilization power supply apparatus according to the present invention may be so structured as to comprise: an output control device which generates a voltage corresponding to a drive current given thereto and outputs it as an output voltage; a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, wherein in a relationship between the drive current and the output voltage, when the output voltage is equal to or higher than a predetermined voltage, a fold-back type drooping characteristic in which the drive current decreases depending on a drop in the output voltage is given, and when the output voltage is lower than the predetermined voltage, the drive current is held constant regardless of a value of the output voltage.

According to this structure, a fold-back type drooping characteristic in which the drive current becomes small depending on a drop in the output voltage due to short-circuit or the like on the output side is achieved, and thereby an overcurrent is prevented from being output erroneously. On the other hand, when the comparison voltage becomes smaller than the given voltage, the drive current is held constant. Accordingly, the constant value can be made as small as possible in a range where a stable operation can be secured at the time of turning on the power supply.

A direct current stabilization power supply apparatus according to the present invention comprises: an output control device which generates a voltage corresponding to a drive current given thereto and outputs it as an output voltage; a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, wherein the drive current limitation portion may be so structured that when the comparison voltage is equal to or lower than a predetermined threshold voltage, the drive current limitation potion carries out an operation to hold the drive current at a predetermined lower-limit current value, or an operation to clamp a lower-limit of the comparison voltage at a predetermined lower-limit voltage value.

According to the present structure, it is possible to secure the drive current as suitably as possible.

DESCRIPTION OF THE DRAWINGS

The objects and features described above and the other objects and features of the present invention will be more apparent from the following description of the preferred embodiments and the attached drawings, in which.

DESCRIPTION OF THE PREFERRED EMBODIMENTS

A first to third embodiments of the present invention are explained hereinafter.

First Embodiment

Figure 1:
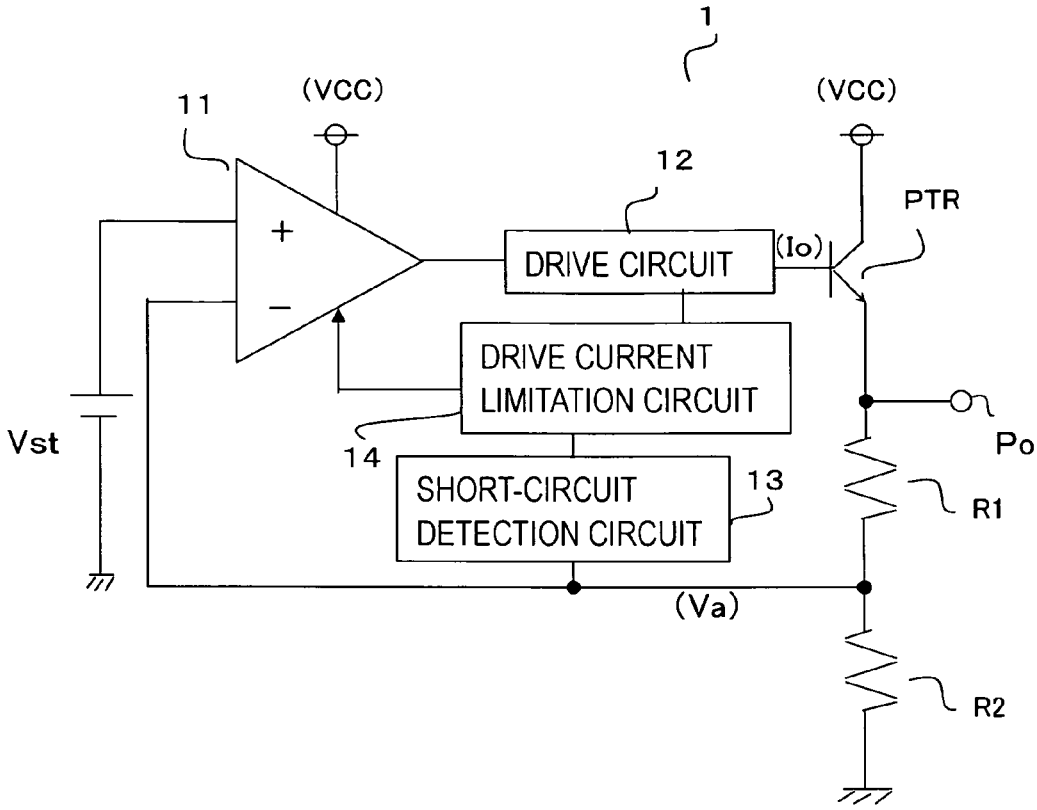
FIG. 1 is a view of a schematic structure of a power supply apparatus 1 according to a first embodiment of the present invention.

As the first embodiment, a direct current (DC) stabilization power supply apparatus (hereinafter, called a power supply apparatus) shown in FIG. 1 is explained. As shown in FIG. 1, a power supply apparatus 1 comprises an error amplifier 11, a drive circuit 12, a short-circuit detection circuit 13, a drive current limitation circuit 14, an output transistor PTR, an output terminal Po, and resistors R1, R2 etc.

The voltage at a non-inverting input terminal of the error amplifier 11 is held at a reference voltage Vst, and an inverting input terminal is connected between the resistors R1 and R2. An output terminal of the error amplifier 11 is connected to an input terminal of the drive circuit 12. According to this structure, the error amplifier 12 outputs a voltage corresponding to a comparison result between the reference voltage Vst and a comparison voltage Va (a voltage between the resistor R1 and the resistor R2). The error amplifier 11 is so designed that if a current Ic described later is input from the drive current limitation circuit 14, the output is limited.

Also, the drive circuit 12 outputs a current (a drive current Io) corresponding to an output from the error amplifier 11 to the base of the output transistor PTR. When an output from the error amplifier 11 is high, the output transistor PTR is turned on. Besides, the drive circuit 12 outputs a current (a drive monitor current Ia) that correlates (determined by a predetermined ratio) with the drive current Io to the drive current limitation circuit 14.

The output transistor PTR comprises a power transistor of the NPN type, and its collector is connected to a power supply VCC and its emitter is connected to a connection point between an output terminal Po and one end of the resistor R1. The other end of the resistor R1 is connected to one end of the resistor R2, and the other end of the resistor R2 is grounded. The power supply VCC may be commonly used as the circuit power supply or may be separated from each other.

Because the short-circuit detection circuit 13 is connected between the resistor R1 and the resistor R2, the comparison voltage Va (a voltage given by dividing an output voltage Vo with these resistors) is input to the sort-circuit detection circuit 13, thereby the short-circuit detection circuit 13 detects whether or not the comparison voltage Va is equal to or lower than 0 V. Then, the short-circuit detection circuit 13 outputs a current Ib corresponding to a result of the detection to the drive current limitation circuit 14. In this way, the short-circuit detection circuit 13 detects, for example, that the output of the power supply apparatus 1 is a negative voltage because of occurrence of short-circuit or the like at the output of the power supply apparatus, and informs the drive current limitation circuit 14 of the detection result.

The drive monitor current Ia described above is input to the drive current limitation circuit 14, and the drive current limitation circuit 14 responds to the current Ia and limits a current (the drive current Io) which is output from the drive circuit 12 to the output transistor PTR so that the current Io does not exceed a predetermined threshold (overcurrent prevention function). Thus, an overcurrent is prevented from being output from the output terminal Po.

If the output of the power supply apparatus 1 is short-circuited because of some cause and the output voltage Vo becomes low, the drive current limitation circuit 14 limits the drive current Ia so that a fold-back type drooping characteristic can be obtained (short-circuit protection function). Besides, if the comparison voltage Va is a negative voltage, the drive current limitation circuit 14 controls the drive current based on a detection result from the short-circuit detection circuit 13 so that the drive current becomes a constant value (a lower-limit current value). It is desirable that this lower-limit current value can be changed to any value, for example, by switch means.

According to the structure described above, the power supply apparatus 1 is so controlled that the comparison voltage Va becomes equal to the reference voltage Vst in a steady state. Therefore, the circuit constant is suitably set, and thereby a desired power can be stably output via the output terminal Po.

Figure 2:
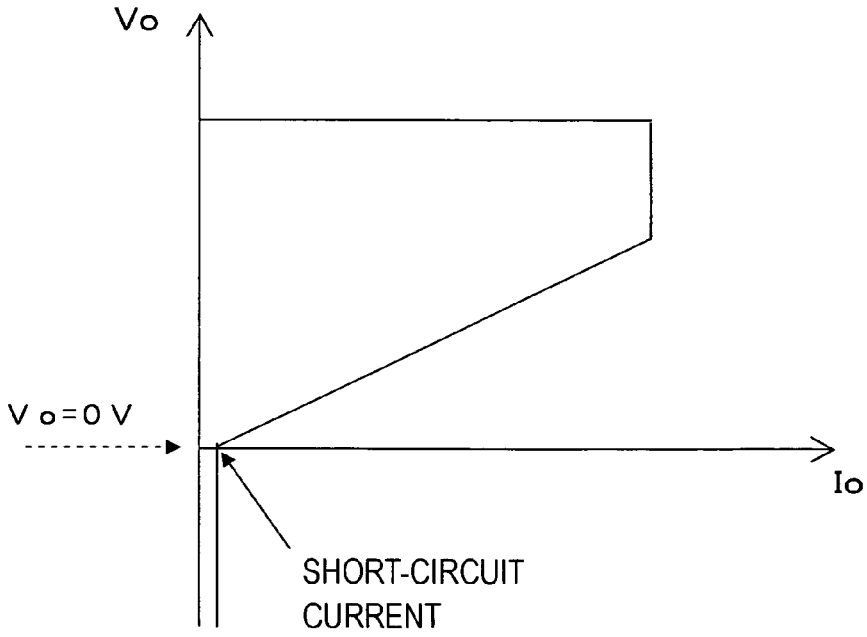
FIG. 2 is a graph showing a relationship between a drive current and an output voltage in the first embodiment of the present invention.

On the other hand, a relationship between the output voltage Vo and the drive current Io is as shown in FIG. 2. In other words, a fold-back type drooping characteristic is obtained as in the conventional power supply apparatus because of the operation of the drive current limitation circuit 14 etc. Accordingly, an overcurrent is prevented from flowing at the time of short-circuit of the output. According to the conventional fold-back type drooping characteristic, if the output voltage Vo becomes a negative voltage equal to or lower than a predetermined value, the drive current becomes 0. However, in the present embodiment, the operation of the drive current limitation circuit 14 allows the drive current Io to be maintained at a constant value (in the present invention, a current value, that is, a short-circuit current value during the time when the output value Vo is 0 V) even if the output voltage Vo becomes a large negative voltage.

Accordingly, in the power supply apparatus 1, even if the power supply apparatus is turned on or its operation is reset with a large negative voltage applied to the output terminal Po, it is possible to drive the output transistor PTR by a drive current following the characteristic shown in FIG. 2.

The drive circuit 12, the short-circuit detection circuit 13, and the drive current limitation circuit 14 in the power supply apparatus 1 having the structure described above can be configured with various circuits. Examples of specific circuit structures are explained hereinafter referring to FIG. 3.

Figure 3:
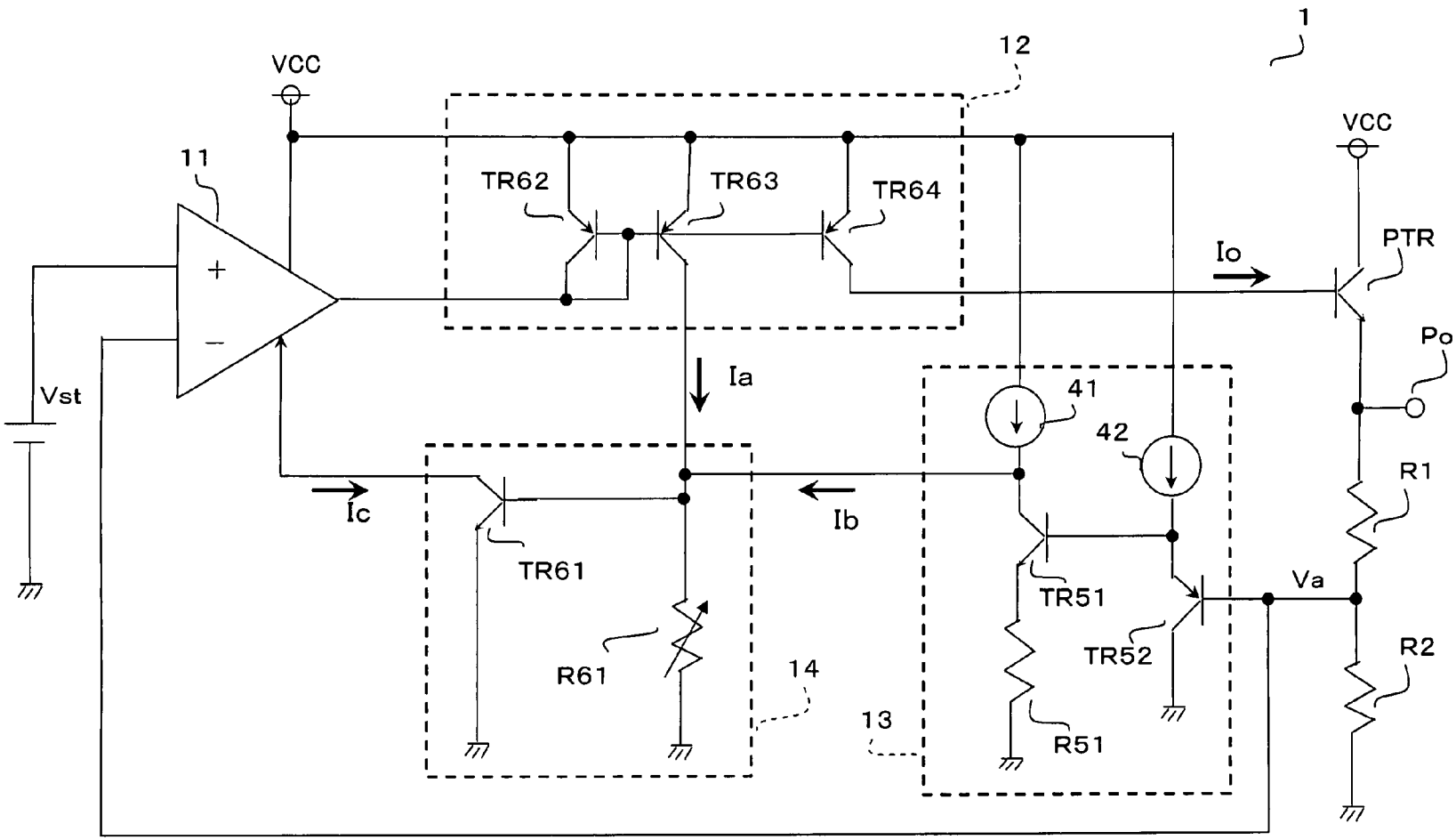
FIG. 3 is a view of a structure of the power supply apparatus 1 according to the first embodiment of the present invention.

As shown in FIG. 3, the drive circuit 12 has PNP transistors (TR62 to TR64) etc. Each emitter of the transistors (TR62 to TR64) is connected to the power supply VCC. Each base of the transistors (T62 to TR64) is connected to the output terminal of the error amplifier 11 and to the collector of the transistor TR62. The collector of the transistor TR63 is connected to the drive current limitation circuit 14, and the collector of the transistor TR64 is connected to the output transistor PTR.

According to this structure, the drive circuit 12 uses the operation of the transistor TR64 to output a current corresponding to an output from the error amplifier 11 to the output transistor PTR. The transistors (TR62 to TR64) each form a current mirror circuit. Accordingly, the drive monitor current Ia (a collector current of the transistor TR63) which gives a ratio of itself to the drive current Io (a collector current of the transistor TR64) is output to the drive current limitation circuit 14.

This drive monitor current Ia is used in the drive current limitation circuit 14 to monitor how large the drive current is. As described above, the drive monitor current Ia is derived from the transistor TR63 which forms the current mirror circuit with the transistor TR64 that outputs the drive current Io. Therefore, according to the drive monitor current Ia, even if there are temperature changes and differences in the characteristics of circuit devices, it is possible to accurately monitor the drive current Io.

The short-circuit detection circuit 13 comprises constant-current sources 41, 42, an NPN transistor TR51, a PNP transistor TR52, a resistor R51 etc. The collector of the transistor TR51 is connected to the constant-current source 41 and to the drive current limitation circuit 14, the base is connected to the emitter of the transistor TR52, and the emitter is grounded via the resistor R51. The emitter of the transistor TR52 is connected to the constant-current source 42, the base is connected between the resistor R1 and the resistor R2, and the collector is grounded.

In the short-circuit detection circuit 13 having the structure described above, when the comparison voltage Va is 0 V or higher, the transistor TR 51 is turned on and the current from the transistor TR51 becomes a predetermined value (e.g, a value given by Va/R51). The current from the constant-current source 41 is set to be equal to the current from the transistor TR51. Accordingly, a current Ib which is output from the collector of the transistor TR51 to the drive current limitation circuit 14 becomes substantially 0 and puts almost no influence on the drive current Io.

On the other hand, at the time of short-circuit (when the comparison voltage becomes 0 V or lower), the base potential of the transistor TR51 drops, and the transistor TR51 is tuned off. Accordingly, the current from the constant-current source 41 is output to the drive current limitation circuit 14 as the current Ib described above. In other words, the short-circuit detection circuit 13 detects that the comparison voltage Va is 0 V or lower and outputs the current Ib to inform the drive current limitation circuit 14 of the detection result. In other words, the short-circuit detection circuit 13 detects whether or not the comparison voltage Va is higher than the threshold voltage (0 V).

The drive current limitation circuit 14 comprises an NPN transistor TR61, a variable resistor R61 and the like. The collector of the transistor TR61 is connected to the error amplifier 11, the base is connected to one end of the variable resistor R61, and the emitter is grounded. The base of the transistor TR61 is also connected to the collector of the transistor TR63 and to the collector of the transistor TR51. The other end of the variable resistor R61 is grounded.

According to this structure, the drive current limitation circuit 14 outputs (draws in from the error amplifier) a current Ic corresponding to the current Ia output from the drive circuit 12 and to the current Ib output from the short-circuit detection circuit 13 to the error amplifier 11, thereby limits the drive current. Because the operation voltage of this circuit is 1 Vbe (base-emitter voltage)+Vce (saturation voltage), it is suitable for low-voltage operation.

In normal operation of the drive current limitation circuit 14, the drive monitor current Ia is input into the base of the transistor TR61. Accordingly, the base voltage of the transistor TR61 rises as the drive current increases, and the transistor TR61 is turned on to output the current Ic, thereby the drive current is limited. In other words, the drive monitor current Ia supplied form the transistor TR63, that is, the current which gives a voltage generated across the resistor R61 as the Vbe (base-emitter voltage, about 0.7 V) is limited by Vbe/R61. For example, if a relationship between the drive monitor current Ia and the drive current Io is 1:50 and the resistor R61 has a resistance of 7 kΩ, the drive current Io is limited to 5 mA. In this way, this circuit detects how large the drive current is and prevents the drive current from becoming an overcurrent based on a result of the detection.

Besides, if the comparison voltage Va becomes 0 V or lower (at the time of short-circuit on the output side of the power supply apparatus 1), the predetermined current Ib is input into the base of the transistor TR61 by the operation of the short-circuit detection circuit. Consequently, the drive monitor current Ia becomes Vbe/R61−Ib, that is, if Ib is 95 uA, Ic becomes about 0.25 mA. Thus, the drive current Io is set to a predetermined lower-limit current value. In other words, this circuit holds the drive current at the lower-limit current value based on a detection result of the short-circuit detection circuit 13.

As described above, according to the circuit structure shown in FIG. 3, the power supply apparatus 1 shown in FIG. 1 can be achieved by suitably setting the circuit constants. In the short-circuit detection circuit 13, if it is hard to accurately match the current from the constant-current source 41 and the collector current from the TR51 with each other, it can be thought that the collector current from the transistor TR51 will become larger than the current from the constant-current source 41.

In this case, because the drive monitor current Ia flowing through the variable resistor R61 is drawn in depending on a difference between the collector current from the transistor TR51 and the current from the constant-current source 41, the control level for the drive current becomes high. To prevent this, a diode is connected in series between the collector of the transistor TR51 and the variable resistor 61 to prevent the current from flowing backward from the drive current limitation circuit 14 to the short-circuit detection circuit 13.

Because the resistor R61 is a variable resistor, it is possible to reduce fluctuation in the current Ib by adjusting the resistance value of the resistor R61. There are various approaches to achieve a variable resistor, one of them is, for example, to connect a plurality of resistance elements in parallel with each other across the upstream side and the downstream side and to trim at least one of the resistance elements.

Figure 4:
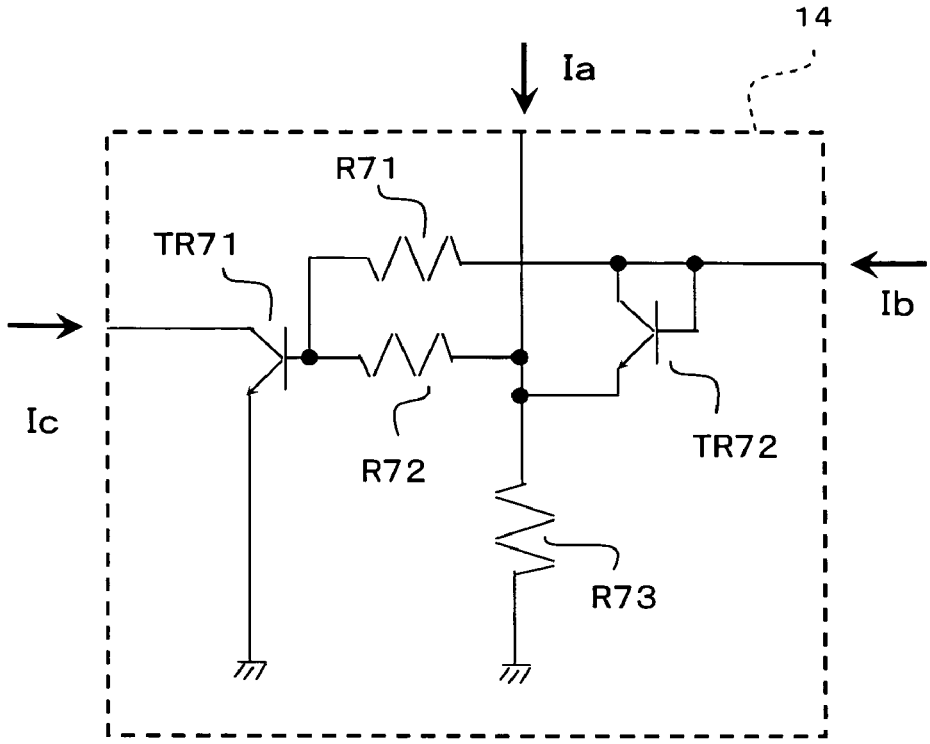
FIG. 4 is a view of another structure of a drive current limitation circuit 14.

Here, another structure of the drive current limitation circuit 14 is explained referring to FIG. 4.

As shown in FIG. 4, the drive current limitation circuit 14 according to the present structure comprises NPN transistors (TR71, TR72), resistors (R71 to R73), and the like. The base of the transistor TR71 is connected to one end of the resistor R71 and to one end of the resistor R72, and the emitter is grounded. The base and collector of the transistor TR72 are connected to the other end of the resistor R71, and the emitter is connected to the other end of the resistor R72 and to one end of the resistor R73. The other end of the resistor R73 is grounded.

The drive monitor current Ia described above is input to the point to which the emitter of the transistor TR72, the resistor R72 and the resistor R73 are connected. Also, the current Ib described above is input to the point to which the base and collector of the transistor TR72 and the resistor R71 are connected. The current which the collector of the transistor TR71 outputs (draws in) corresponds to the current Ic described above. As described above, the current Ib is input into the base of the transistor TR71 via the resistor R71, and at the same time, it is input into an anode of a diode of the base-collector short of the transistor TR72.

In the drive current limitation circuit 14 having the structure described above, during normal time, the operation is substantially the same as that in the drive current limitation circuit 14 shown in FIG. 3. However, at the time of short-circuit on the output side of the power supply apparatus 1, the current Ib is input from the short-circuit detection circuit 13, and the base potential Vb71 of the transistor TR71 which limits the drive current is given as follows with the base-emitter voltage Vbe72 (approximately, 0.7 V) of the transistor TR72:

$$Vb71=Vbe72\times\{R72/(R71+R72)\}+(Ia+Ib)\times R73$$

The drive current Io is limited by the current Ib which is the current at the time when the voltage Vb71 reaches the voltage (approximately, 0.7 V) to turn on the transistor TR71.

As in the case described above, if a relationship between the drive monitor current Ia and the drive current Io is 1:50 and the resistor R73 has a resistance of 7 kΩ, the drive current Io is limited to 5 mA. At the time of shot-circuit, if the resistor R71 has a resistance of 10 kΩ, the resistor R72 has a resistance of 90 kΩ and Ib is 5 uA, the drive current Io becomes approximately 0.25 mA.

According to the drive current limitation circuit 14, compared with that shown in FIG. 3, changes in the drive current Io corresponding to fluctuations in the current Ib can be curbed to a low level. For example, in the drive current limitation circuit shown in FIG. 3, if the current Ib becomes large 5%, the drive current Io changes from 0.25 mA to 0.125 mA. In contrast, in the drive current limitation circuit shown in FIG. 4, even if the current Ib becomes large 5%, the drive current Io changes only from 0.25 mA to 0.238 mA.

If temperature changes occur, the characteristics (especially Hfe) of the output transistor PTR also change, and the current flowing through the output transistor PTR also changes. Accordingly, at the time of short-circuit on the output side of the power supply apparatus 1, the current flowing through the output transistor PTR can change depending on changes of the Hfe. Therefore, it is desirable that a function to correct current changes depending on changes of the temperature characteristic of the output transistor PTR is provided. As an approach to achieve this function, the temperature characteristic of a circuit element (e.g., one of the constant-current sources) that determines the drive current at the time of short-circuit and the temperature characteristic of the output transistor PTR are so set that they are cancelled with each other. In this way, it is possible to provide the power supply apparatus 1 as a DC stabilization power supply apparatus that has a stable characteristic for temperature changes.

To drive and control the output transistor PTR, the drive current is used to monitor the current flowing through the output transistor PTR. The current flowing through the output transistor PTR changes depending on changes of the Hfe of the output transistor PTR caused by temperature changes. Accordingly, the current which flows through the output transistor PTR at the time of short-circuit also changes depending on the changes of the Hfe. However, if the temperature characteristic of the output transistor is corrected by adjusting the temperature characteristic of the constant-current source which determines the drive current at the time of short-circuit, thereby a power supply apparatus which has a stable characteristic for temperature changes can be provided.

In a case where the drive current Io fluctuates because of changes in a ratio of the drive monitor current Ib to the drive current Io, a short-circuit current fluctuates greatly if the current Ib is not adjusted like the variable resistor R61. For example, in the circuit in FIG. 3, if the resistance of the variable resistor R61 is adjusted 5%, the short-circuit current changes from 0.25 mA to 0.12 mA, and if it is adjusted 10%, the short-circuit current becomes 0. Therefore, although it is originally an advantage of the present invention that the power supply apparatus 1 can make a startup from a negative voltage, it becomes hard to make such startup.

On the other hand, according to the circuit shown in FIG. 4, if the resistor R73 is a variable resistor and its resistance is adjusted 5%, the short-circuit current changes from 0.25 mA to 0.226 mA, and becomes 0.205 mA for even an adjustment of 10%, that is, it does not become 0 V. Thus, the short-circuit current does not become 0 for the adjustment of the variable resistor, and it becomes easy to allow the output voltage Vo to start from a negative voltage.

Second Embodiment

Next, a second embodiment of the present invention is explained. The second embodiment is the same as the first embodiment in principle except the short-circuit detection circuit 13 and the drive current limitation circuit 14, and the same explanation is skipped.

In the present embodiment, a clamp circuit 15 is used instead of the short-circuit detection circuit 13, and the comparison voltage Va is clamped so that it does not become lower than a predetermined lower-limit voltage value even if the output voltage Vo excessively drops.

Figure 5:
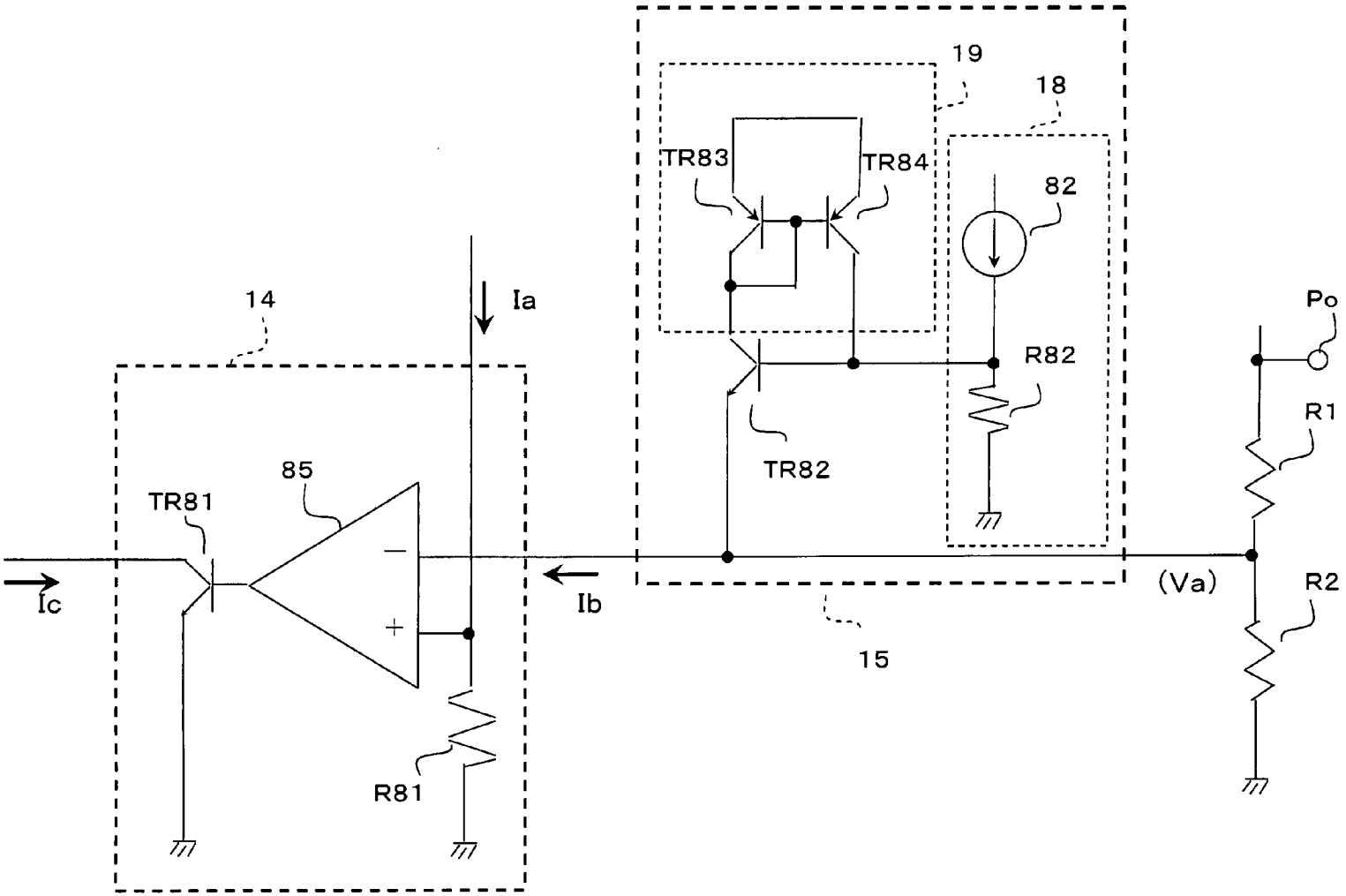
FIG. 5 is a view of a structure of the power supply apparatus 1 according to a second embodiment of the present invention.

Here, circuit structures of the clamp circuit 15 and the drive current limitation circuit 14 are shown in FIG. 5. As shown in FIG. 5, the clamp circuit 15 comprises PNP transistors (TR83, TR84), an NPN transistor TR82, a constant-current source 82, a resistor R82 etc.

The emitters of the transistors TR83 and TR84 are connected to each other, and the bases of the transistors TR83 and TR84 are also connected to each other to form a current mirror circuit. Besides, the collector of the transistor TR83 is connected to the base of the transistor TR83 and to the collector of the transistor TR82. The base of the transistor TR82 is connected to the collector of the transistor T84, the downstream side of the constant-current source 82 and one end of the resistor R82. The other end of the resistor R82 is grounded. The emitter of the transistor TR82 is connected to a point between the resistors R1 and R2 and to the inverting input terminal of the comparator 85.

The constant-current source 82 and the resistor R82 comprise a clamp reference voltage circuit 18 (voltage generation means) that generates a predetermined clamp reference voltage Vclp, and the transistors TR83 and TR84 comprise a clamp voltage correction circuit 19.

The drive current limitation circuit 14 comprises the comparator 85, the NPN transistor TR81, the resistor R81 etc. The collector of the transistor TR81 outputs the current Ic described above to (or draws in the current Ic from) the error amplifier 11. The base of the transistor TR81 is connected to the output terminal of the comparator 85 and the emitter is grounded. The non-inverting input terminal of the comparator 85 is connected to the other end of the resistor R81 whose one end is grounded, and the inverting input terminal of the comparator 85 is connected between the resistors R1 and R2. Thus, the current Ib described above is input to the inverting input terminal of the comparator 85, and the drive monitor current Ia described above flows to the connection point between the non-inverting input terminal of the comparator 85 and the resistor R81.

According to the structure described above, the comparison voltage Va is given to the inverting input terminal of the comparator 85, and a voltage generated by the drive monitor current Ia and the resistor R81 (drive monitor resistor) is given to the non-inverting input terminal of the comparator 85. When the output from the comparator 85 is input into the base of the transistor TR81, the TR81 is turned on and functions to limit the drive current Io described above. In other words, when the output from the comparator 85 is high, the TR81 is turned on to limit the drive current.

The transistors TR83 and TR84 comprising the current mirror circuit feed back the collector current from the transistor TR82 to the clamp reference voltage circuit 18. In this way, the clamp circuit 15 functions to clamp the comparison voltage Va to a voltage which is lower than the clamp reference voltage Vclp by a base-emitter voltage of the transistor TR82. The clamp function is so set that it works when the comparison voltage Va drops by a predetermined value or more.

If the product of the drive monitor current Ia proportionate to the drive current by the resistor R81 exceeds the comparison voltage Va, the drive current limitation circuit 14 turns on the transistor TR81 connected to the output of the comparator 85 to limit the drive current. In other words, a relationship between the comparison voltage Va and the drive monitor current Ia becomes Ia=Va/R81, and the drive monitor current Ia is limited according to this relational expression.

On the other hand, if the output of the power supply apparatus 1 is short-circuited, the comparison voltage Va drops. At this time, the drive current Ia is lowered according to the relational expression (Ia=Va/R81). If the output voltage from the power supply apparatus 1 drops to a negative voltage, the comparison voltage Va also could drop. However, by the clamp function of the clamp circuit 15, the comparison voltage Va is clamped at a voltage which is lower than the clamp reference voltage Vclp by a base-emitter voltage of the transistor T82.

Here, if the output voltage from the power supply apparatus 1 becomes lower than 0 V, the base-emitter voltage of the transistor TR82 becomes large and the current flowing through the transistor TR82 increases. Accordingly, because the base-emitter voltage gradually becomes large, the comparison voltage Va gradually reaches 0 V. By the clamp voltage correction circuit 19, the current from the transistor TR82 is fed back to the clamp reference voltage circuit 18, and the clamp reference voltage Vclp is adjusted by an increment voltage ΔVbe (VT×Ln (ΔIC), wherein VT=kT/q) in the base-emitter voltage of the transistor TR82, thereby the comparison voltage Va can be corrected.

Figure 6:
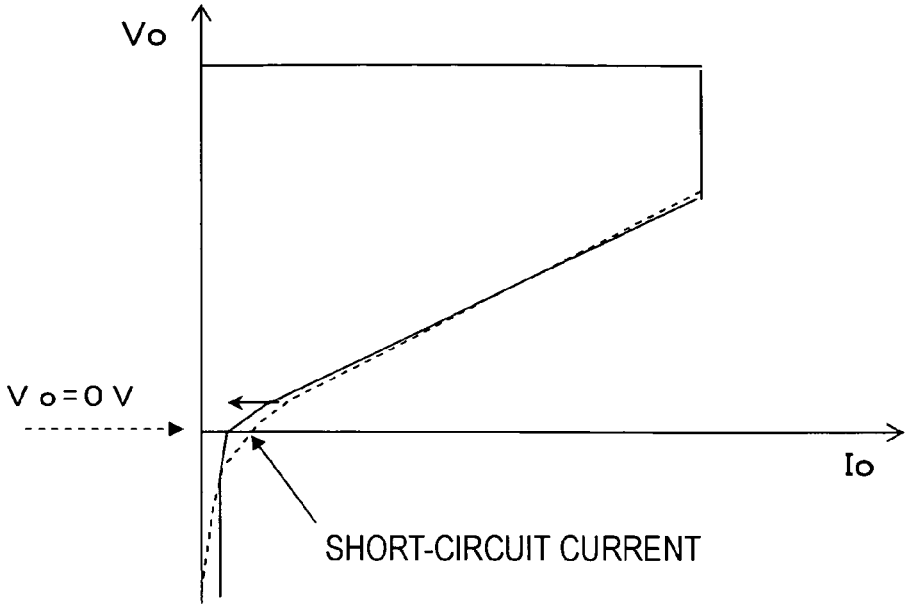
FIG. 6 is a graph showing a relationship between a drive current and an output voltage in the second embodiment of the present invention.

As described above, by correcting the comparison voltage Va with the clamp voltage correction circuit, even if the output voltage Vo becomes a negative voltage as shown in FIG. 6, it is possible to prevent the drive current Io from becoming 0. In FIG. 6, the curve obtained by use of the circuit according to the present embodiment is shown by a solid line, and the curve obtained in the conventional case where the clamp correction is not carried out is shown by a broken line. As seen from this figure, in the present embodiment, the short-circuit current at the time when the output voltage Vo is 0 V can be made small compared with that in the case where the clamp correction is not carried out.

Figure 7:
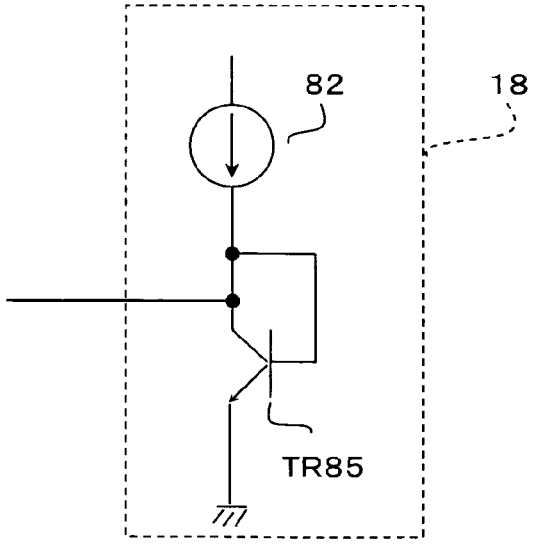
FIG. 7 is a view of another structure of a clamp reference voltage circuit 18.

Another structure example of the clamp reference voltage circuit 18 is shown in FIG. 7. As shown in this figure, the clamp reference voltage circuit 18 comprises a constant-current source 82 and an NPN transistor TR85. The collector of the transistor TR85 is connected to the downstream side of the constant-current source 82, the base is connected to the collector, and the emitter is grounded. The collector of the transistor TR85 is connected to the base of the transistor TR82. A transistor having the same characteristics as those of the transistor TR82 (the second transistor) is used as the transistor TR85 (the first transistor).

According to the clamp reference voltage circuit 18 having the present structure, the clamp reference voltage Vclp is generated by the transistor TR85 and the constant-current source 82 instead of the resistor R82 and the constant-current source 82. Accordingly, differences in the device performance and shifts in the temperature characteristics of the transistor TR85 can be cancelled by those of the transistor TR82.

Figure 8:
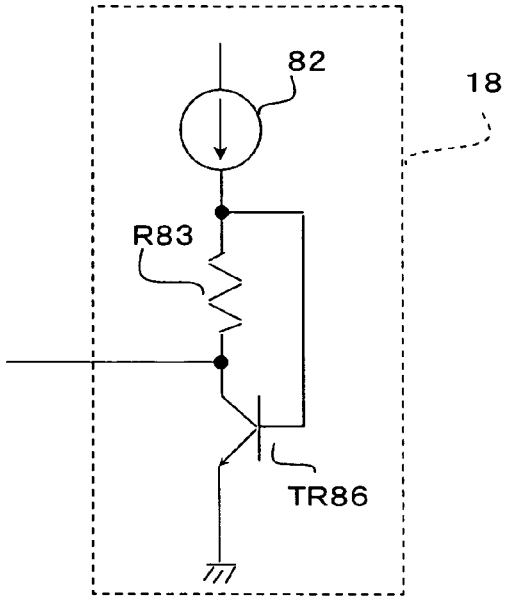
FIG. 8 is a view of still another structure of the clamp reference voltage circuit 18.

A still another structure example of the clamp reference voltage circuit 18 described above is shown in FIG. 8. As shown in this figure, the clamp reference voltage circuit 18 comprises the constant-current source 82, a resistor R83 and an NPN transistor TR86. One end of the resistor R83 is connected to the downstream side of the constant-current source 82, and the other end is connected to the collector of the transistor TR86. The base of the transistor TR86 is connected between the constant-current source 82 and the resistor R83, and the emitter is grounded. A connection point between the collector of the transistor TR86 and the resistor R83 is connected to the base of the transistor TR82.

Figure 9:
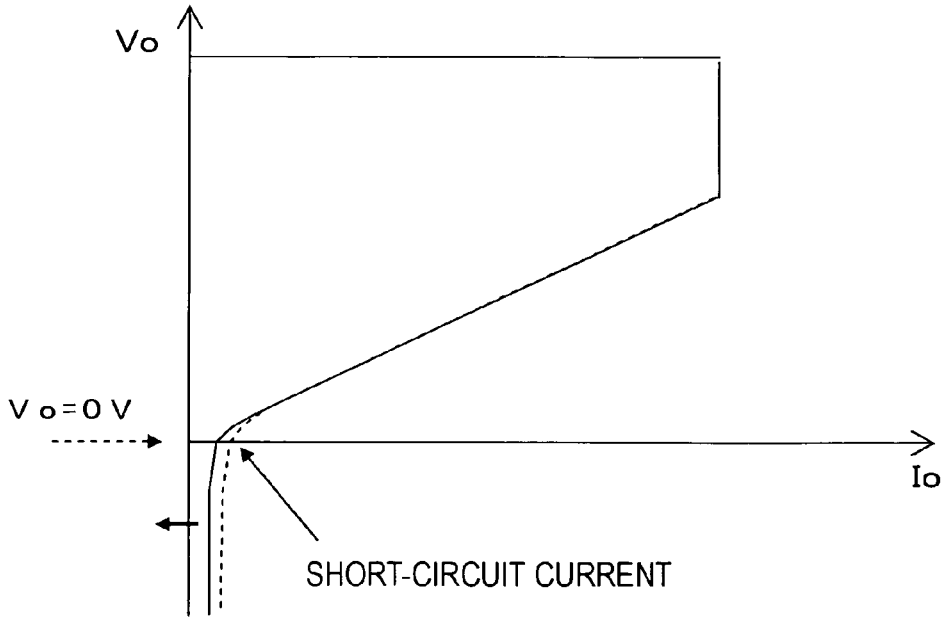
FIG. 9 is another graph showing a relationship between the drive current and the output voltage in the second embodiment of the present invention.

According to the clamp reference voltage circuit 18 having the present structure, the resistor R83 is inserted between the collector and the base of the transistor TR86 to finely adjust a clamp level, and a fine adjustment is achieved to lower the clamp voltage. In other words, by using an appropriate resistor R83, a desired value of the clamp reference voltage Vclp can be obtained. Here, a graph illustrating a fold-back type drooping characteristic in the case where the present structure is employed is shown in FIG. 9. In this figure, the solid line indicates the characteristic after the fine adjustment, and the broken line indicates the characteristic before the fine adjustment.

As shown in this figure, because the clamp level is lowered by the inserted resistor R83, the drive current at the time of short-circuit on the output side of the power supply apparatus 1 can be made small. To raise the clamp level, the collector and the base of the transistor TR86 are short-circuited with each other, the resistor R83 is inserted between the transistor TR86 (which can be regarded as a diode) and the constant-current circuit 82, a voltage at the connection point between the resistor R83 and the constant-current source 82 is made equal to the clamp reference voltage Vclp, thereby the clamp level can be raised.

Third Embodiment

A third embodiment of the present invention is explained. The third embodiment is the same as the second embodiment in principle except the structures of the clamp circuit 15 and the drive current limitation circuit 14, and the same explanation is skipped.

Figure 10:
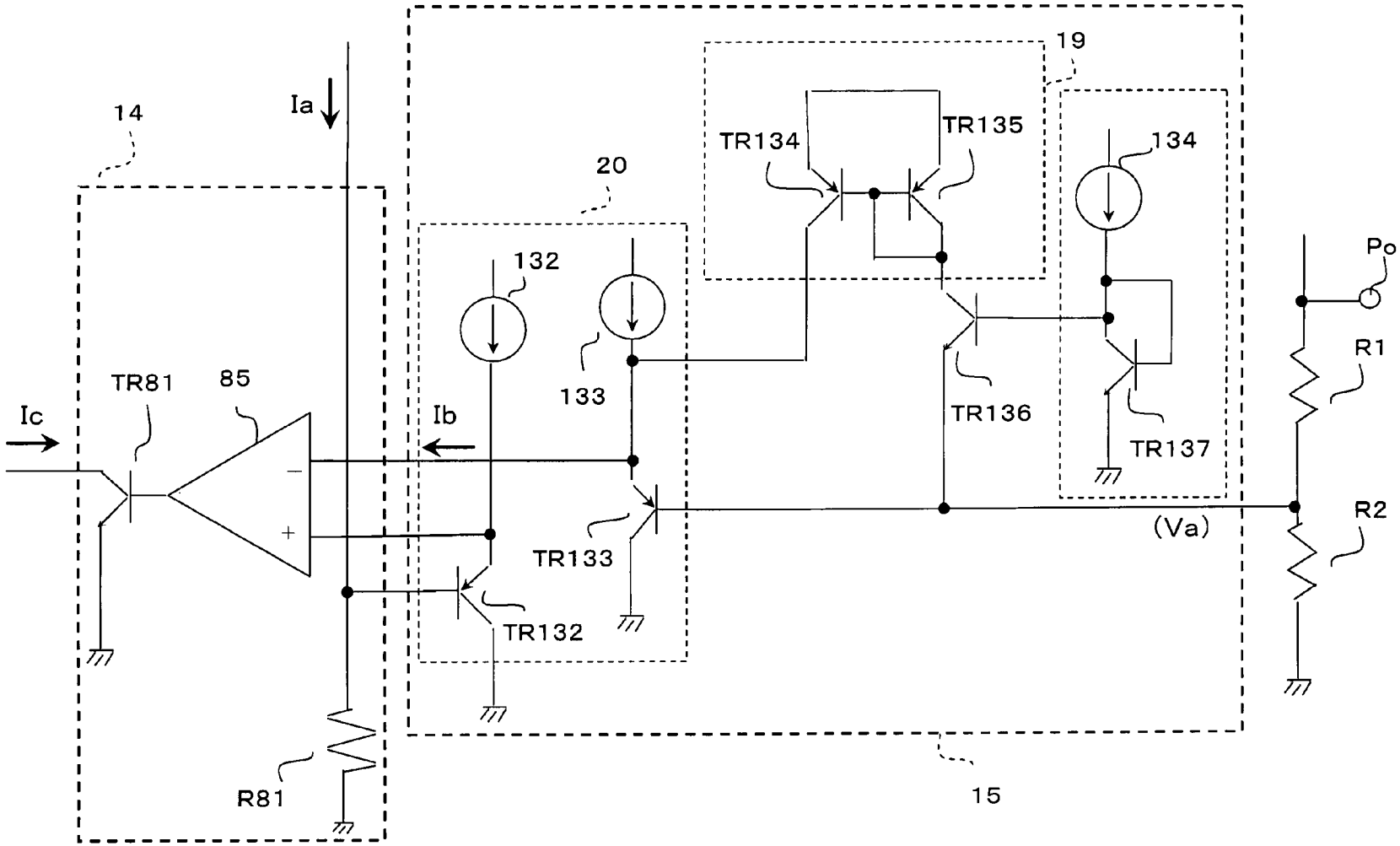
FIG. 10 is a view f a structure of the power supply apparatus 1 according to a third embodiment of the present invention.

Circuit structures of the clamp circuit 15 and the drive current limitation circuit 14 according to the present embodiment are shown in FIG. 10. As shown in this figure, the clamp circuit 15 comprises the clamp voltage correction circuit 19, the clamp reference voltage circuit 18, a level shift circuit 20, an NPN transistor TR136 etc.

The clamp voltage correction circuit 19 includes PNP transistors (TR134, TR135), and their emitters are connected to each other, and the bases are also connected to each other. The collector of the transistor TR134 is connected to the emitter of the transistor TR133 of the level shift circuit 20, and the collector of the transistor TR135 is connected to the base of the transistor TR135 and to the collector of the NPN transistor TR136.

The clamp reference voltage circuit 18 includes a constant-current source 134 and an NPN transistor TR137. The downstream side of the constant-current source 134 is connected to the collector and base of the transistor TR137 and to the base of the transistor TR136. The emitter of the transistor TR137 is grounded. The emitter of the transistor TR136 is connected between the resistors R1 and R2.

The level shift circuit 20 includes constant-current sources (132, 133) and PNP transistors (TR132, TR133). The emitter of the transistor TR132 is connected to the downstream side of the constant-current source 132 and to the non-inverting input terminal of the comparator 85, and the collector is grounded. The base of the transistor TR132 is connected to the other end of the resistor R81 whose one end is grounded. The emitter of the transistor TR133 is connected to the downstream side of the constant-current source 133, the base is connected between the resistors R1 and R2, and the collector is grounded.

On the other hand, the drive current limitation circuit 14 comprises the comparator 85, the NPN transistor TR81, and the resistor R81. The collector of the transistor TR81 outputs (that is, draws in) the current Ic described above to the error amplifier 11. The base of the transistor TR81 is connected to the output terminal of the comparator 85, and the emitter is grounded. The non-inverting input terminal is connected to the emitter of the transistor TR132, and the inverting input terminal of the comparator 85 is connected to the emitter of the transistor TR132. One end of the resistor R81 is grounded, the other end is connected to the base of the TR132, and the drive monitor current Ia described above flows to this connection point between the base of the TR132 and the other end of the resistor R81.

As described above, in the present embodiment, the level shift circuit 20 is added on the previous stage to the comparator 85 used in the structure according to the second embodiment, thereby the correction approach (target) of the clamp voltage by the clamp voltage correction circuit 19 is different from that in the second embodiment. Specifically, in the second embodiment, the base-emitter voltage to be clamped is corrected by the feedback to the clamp circuit 15, while in the present embodiment, the correction is carried out through the transistor TR133 of the level shift circuit 20. The level shift circuit 20 can be considered as a circuit that shifts the largeness of the comparison voltage Va.

In the correction approach using the structure according to the second embodiment, it is possible to form the necessary circuits with the smallest possible number of devices, but because the positive feedback is carried out, the operation could be somewhat unstable. For example, because the positive feedback is carried out at the time when the power supply is turned off, a leak current from the transistors in the loop can be amplified. However, in the correction approach according to the present embodiment, because feedforward control is carried out, the problem that the operation becomes unstable can be improved although the number of devices to form the circuit increases slightly.

Figure 11:
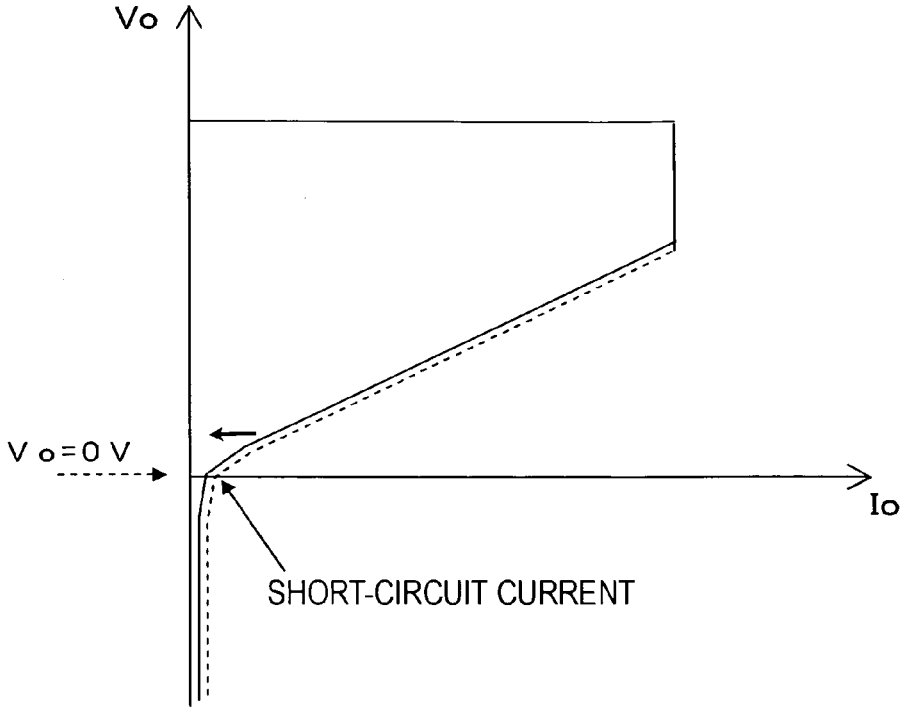
FIG. 11 is a graph showing a relationship between a drive current and an output voltage in the third embodiment of the present invention.
Figure 12:
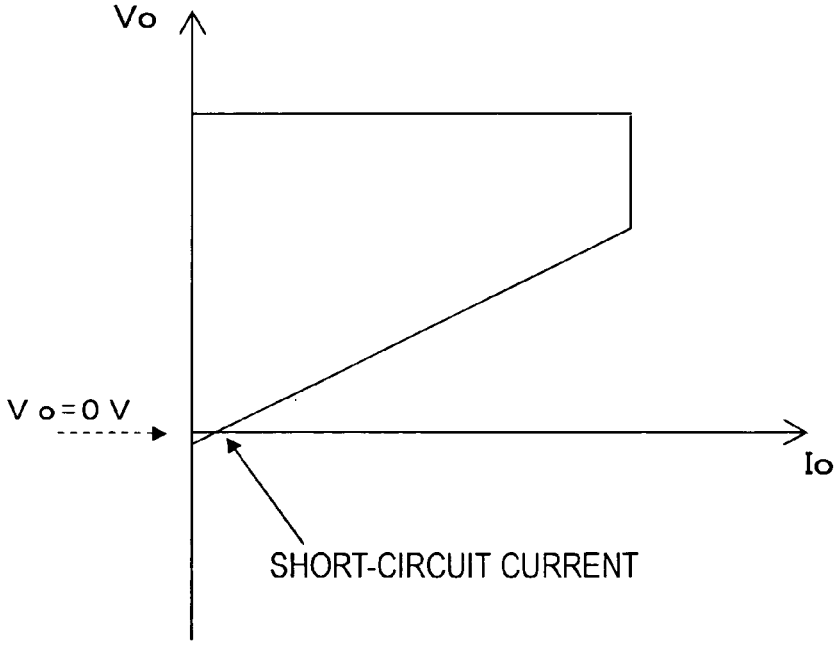
FIG. 12 is a graph showing a fold-back type drooping characteristic in a conventional power supply apparatus.

In the structure according to the present embodiment, by adjusting the characteristics (the size and the like) of the transistor TR133 and the output current from the constant-current source 133, it is possible to adjust the value (an offset amount for a short-circuit current with a reference current of 0 A) of the drive current Io at the time of short-circuit on the output side of the power supply apparatus 1. A graph illustrating a fold-back type drooping characteristic in the case where such adjustment is performed is shown in FIG. 11 (the solid line indicates the characteristic after the adjustment, and the broken line indicates the characteristic before the adjustment). In this case, the adjustment amount is given by $VT \times Ln(n)$ (wherein, n is a natural number, $VT=kT/q$). Thus, the offset amount can be finely adjusted, and the fluctuations can be reduced compared with those in the apparatus which uses resistors.

Figure 13:
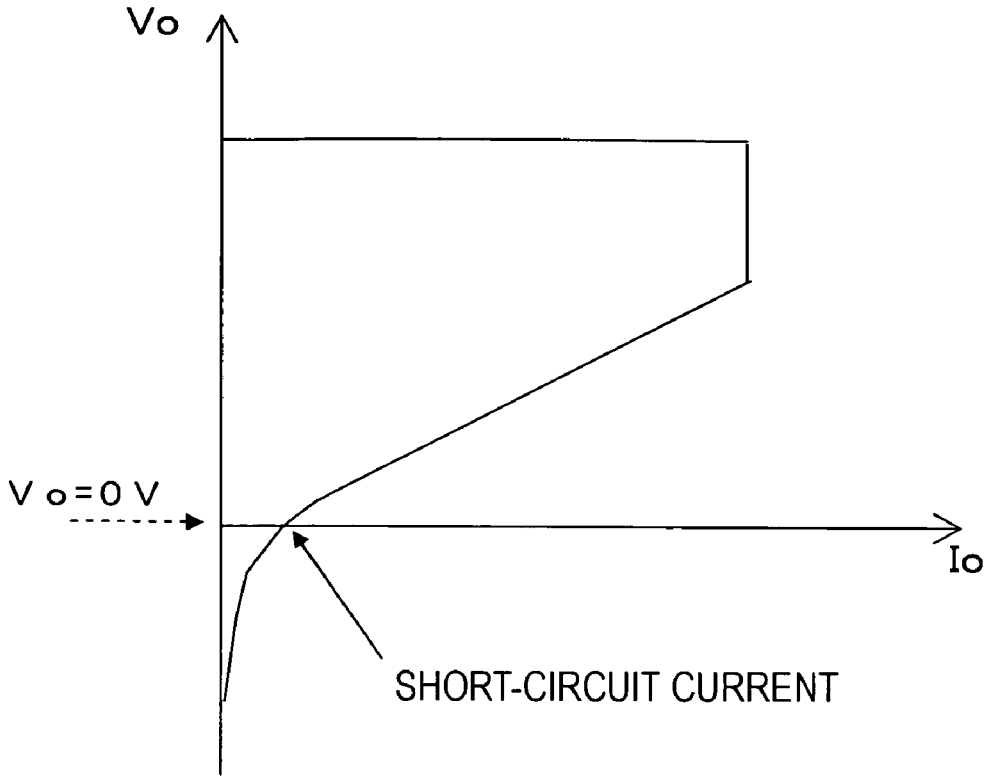
FIG. 13 is a graph showing another fold-back type drooping characteristic in a conventional power supply apparatus.

Conclusion: In DC stabilization power supply apparatuses having the conventional fold-back type drooping characteristic, for example, if the output voltage becomes a relatively large negative voltage, it is sometimes hard to start the apparatus. Even in the power supply apparatus which has the fold-back type drooping characteristic shown in FIG. 13, if the output voltage becomes a negative voltage, it is hard to secure a suitable drive current.

However, in the embodiments of the present invention explained above, if it is detected that the comparison voltage (or the output voltage) is equal to or lower than the predetermined threshold voltage, the operation to forcibly set the drive current (to clamp the current) to a value (the lower-limit current value) which is not detrimental to the startup of the apparatus, or the operation to clamp the lower-limit value of the comparison voltage at a predetermined lower-limit voltage value is carried out. By such operation, it is easy to adjust the drive current to a suitable value (the smallest possible value in a range where a stable operation can be secured at the time of turning on the power supply).

The embodiments of the present invention have been explained above. However, the present invention is not limited by the contents of the above embodiments, and various modifications can be made without departing from the scope of the present invention.

What is claimed is:

1. A direct current stabilization power supply apparatus, comprising:

an output control device which generates a voltage corresponding to a drive current given thereto and outputs it as an output voltage;

a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage;

wherein the drive current limitation portion includes current clamp means which holds the drive current at a predetermined lower-limit current value when the comparison voltage is equal to or lower than a predetermined threshold voltage.

2. The direct current stabilization power supply apparatus according to claim 1, further comprising a detection portion for detecting whether or not the comparison voltage is higher than the threshold voltage, and the drive current limitation portion holds the drive current at the lower-limit current value based on a detection result from the detection portion.

3. The direct current stabilization power supply apparatus according to claim 2, further comprising:

a drive current detection portion for detecting how large the drive current is; and an overcurrent prevention portion for preventing the drive current from becoming an overcurrent based on a detection result from the drive current detection portion.

4. The direct current stabilization power supply apparatus according to claim 3, wherein the drive current detection portion includes a current mirror circuit and uses the current mirror circuit to obtain a drive monitor current which correlates with the drive current.

5. The direct current stabilization power supply apparatus according to claim 1, further comprising clamp means for changing the lower-limit current value to any value.

6. A direct current stabilization power supply apparatus, comprising:

an output control device which generates a voltage corresponding to a drive current given and outputs it as an output voltage;

a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, the apparatus further comprising;

voltage clamp means for clamping a lower-limit value of the comparison voltage at a predetermined lower-limit voltage value; and means for correcting a fluctuation in a voltage clamped by the clamp means.

7. The direct current stabilization power supply apparatus according to claim 6, wherein the voltage clamp means includes voltage generation means which generates a predetermined clamp reference voltage and uses the clamp reference voltage to carry out the clamp operation.

8. The direct current stabilization power supply apparatus according to claim 6, further comprising a shift circuit for shifting a value of the comparison voltage.

9. The direct current stabilization power supply apparatus according to claim 7, wherein the voltage generation means uses a first transistor to generate the clamp reference voltage, and the voltage clamp means includes a second transistor which carries out the clamp operation using the clamp reference voltage input, wherein the first and second transistor are set to characteristics identical to each other.

10. The direct current stabilization power supply apparatus according to claim 7, wherein the clamp reference voltage can be changed to another value.

11. The direct current stabilization power supply apparatus according to claim 4, further comprising a variable resistor portion to one end of which the drive monitor current is input and the other end of which is grounded, and the overcurrent prevention portion uses a voltage generated at the one end of the variable resistor portion to prevent the drive current from becoming an overcurrent.

12. The direct current stabilization power supply apparatus according to claim 11, wherein the variable resistor portion includes a plurality of resistance elements disposed in parallel with each other across the one end and the other end thereof, wherein each of the resistor elements can be trimmed.

13. A direct current stabilization power supply apparatus, comprising:

an output control device which generates a voltage corresponding to a drive current given and outputs it as an output voltage;

a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, wherein, in a relationship between the drive current and the output voltage, when the output voltage is equal to or higher than a predetermined voltage, a fold-back type drooping characteristic in which the drive current decreases depending on a drop in the output voltage is given, and when the output voltage is lower than the predetermined voltage, the drive current is held constant regardless of a value of the output voltage.

14. A direct current stabilization power supply apparatus, comprising:

an output control device which generates a voltage corresponding to a drive current given and outputs it as an output voltage;

a direct current stabilization portion which gives the drive current to the output control device to equalize a comparison voltage corresponding to the output voltage with a predetermined reference voltage and makes the output control device generate a desired output voltage; and a drive current limitation portion which monitors the comparison voltage and lowers the drive current according to a drop in the comparison voltage, wherein, the drive current limitation portion carries out an operation to hold the drive current at a predetermined lower-limit current value when the comparison voltage is equal to or lower than a predetermined voltage, or an operation to clamp a lower-limit value of the comparison voltage at a predetermined voltage value.

* * * * *